US007558397B2

(12) United States Patent
Akino

(10) Patent No.: US 7,558,397 B2
(45) Date of Patent: Jul. 7, 2009

(54) CONDENSER MICROPHONE

(75) Inventor: Hiroshi Akino, Machida (JP)

(73) Assignee: Kabushiki Kaisha Audio-Technica, Machida-shi, Tokyo (JP)

( * ) Notice: Subject to any disclaimer, the term of this patent is extended or adjusted under 35 U.S.C. 154(b) by 830 days.

(21) Appl. No.: 11/256,997

(22) Filed: Oct. 25, 2005

(65) Prior Publication Data

US 2006/0088169 A1 Apr. 27, 2006

(30) Foreign Application Priority Data

Oct. 27, 2004 (JP) ..... 2004-311800

(51) Int. Cl.
*H04R 25/00* (2006.01)

(52) U.S. Cl. ..... 381/369; 381/355; 381/368

(58) Field of Classification Search ..... 381/355–358, 381/360, 361–363, 368–369, 173–174
See application file for complete search history.

(56) References Cited

U.S. PATENT DOCUMENTS 6,961,437 B2 * 11/2005 Kondo et al. ..... 381/369
7,050,597 B2 * 5/2006 Akino ..... 381/369
7,106,869 B2 * 9/2006 Kanda et al. ..... 381/369

* cited by examiner

*Primary Examiner*—Suhan Ni
(74) *Attorney, Agent, or Firm*—Manabu Kanesaka

(57) ABSTRACT

In a condenser microphone of double shield construction having an external cylinder and an internal cylinder, both of which are made of a metal, especially like a line microphone, impedance between shield parts against a high-frequency current caused by electromagnetic waves is always kept low, by which the occurrence of noise caused by electromagnetic waves is prevented. In a condenser microphone which includes an external cylinder 11 and an internal cylinder 12, both of which are made of a metal, the internal cylinder 12 being arranged in the external cylinder 11 via shock mount members 20*a* to 20*f* having elasticity, and the internal cylinder 12 containing a substrate 15 including an audio output circuit of a condenser microphone unit 14, a gasket formed by covering the surface of a core formed of an elastic material with a conductive material is used as the shock mount members 20*a* to 20*f*, by which the external cylinder 11 and the internal cylinder 12 are connected electrically to each other via the gasket.

3 Claims, 2 Drawing Sheets

CONDENSER MICROPHONE

TECHNICAL FIELD

The present invention relates to a condenser microphone and, more particularly, to a shield technology for a microphone case.

BACKGROUND ART

A condenser microphone has a microphone unit in which a diaphragm and a backplate are arranged opposedly, and the microphone unit incorporates an impedance converter because the impedance of the microphone unit is very high. As the impedance converter, a field effect transistor (FET) is usually used, but a vacuum tube is used on rare occasions.

A substrate including an audio output circuit of microphone unit is housed in a metallic microphone case. If strong electromagnetic waves are applied from the outside, a high-frequency current caused the electromagnetic waves intrudes into the microphone case and is detected by the impedance converter etc., whereby noise is sometimes generated. The noise caused by the electromagnetic waves is frequently generated when a cellular phone is used in the vicinity of the microphone.

To prevent this noise, for example, the microphone case is connected to a shield coating of a microphone cable via a connecting member. Alternatively, for a line microphone in which a metallic sound tube is housed in a slender and cylindrical microphone case, they are connected electrically, for example, by a leaf spring to form a double shield construction.

However, each of the connecting portions provides a surface contact between metal materials seemingly, but actually provides a point contact microscopically. A contact portion formed by such a point contact exhibits a high impedance in terms of a high-frequency current, and the high-frequency current caused by electromagnetic waves enters into the microphone case from the contact portion. Therefore, it cannot be said that a sufficient shield is formed against electromagnetic waves.

Also, if external stress is applied to the contact portion of this kind, the contact position is displaced frequently, and accordingly the impedance is changed. This suddenly increases the noise caused by electromagnetic waves in some cases. Furthermore, if the displacement of contact position is large, contact noise may occur apart from the noise caused by electromagnetic waves.

Accordingly, a problem of the present invention is that in a condenser microphone of double shield construction having an external cylinder and an internal cylinder, both of which are made of a metal, especially like a line microphone (gun microphone), impedance between shield parts against a high-frequency current caused by electromagnetic waves is always kept low, by which the occurrence of noise caused by electromagnetic waves is prevented.

SUMMARY OF THE INVENTION

To solve the above problem, the present invention provides a condenser microphone which includes an external cylinder and an internal cylinder, both of which are made of a metal, the internal cylinder being arranged in the external cylinder via shock mount members having elasticity, and the internal cylinder containing a substrate including an audio output circuit of a condenser microphone unit, characterized in that a gasket formed by covering the surface of a core formed of an elastic material with a conductive material is used as the shock mount members, by which the external cylinder and the internal cylinder are connected electrically to each other via the gasket.

According to this configuration, since the core of the gasket has elasticity, the external cylinder and the internal cylinder are connected electrically to each other at many points by the conductive material covering the surface of the core. Therefore, reliable electrical connection exhibiting a low impedance against a high-frequency current caused by electromagnetic waves is assured, and thereby the occurrence of noise caused by electromagnetic waves can be prevented.

As a preferred mode, a mode in which the condenser microphone unit is supported in the internal cylinder via the gasket is embraced. Also, as a preferred mode, the present invention also embraces a mode in which a microphone cable consisting of a two-core shield coated wire is provided, the microphone cable being provided with a connecting member which is connected electrically to the shield coating, and the connecting member is fitted to one end of the external cylinder via the gasket and is screw-mounted to the external cylinder.

According to these configurations, even if a shield part is displaced by applied external stress, many contacts are always connected and hence a low impedance is maintained, so that the occurrence of contact noise can also be prevented.

DETAILED DESCRIPTION

Figure 1:
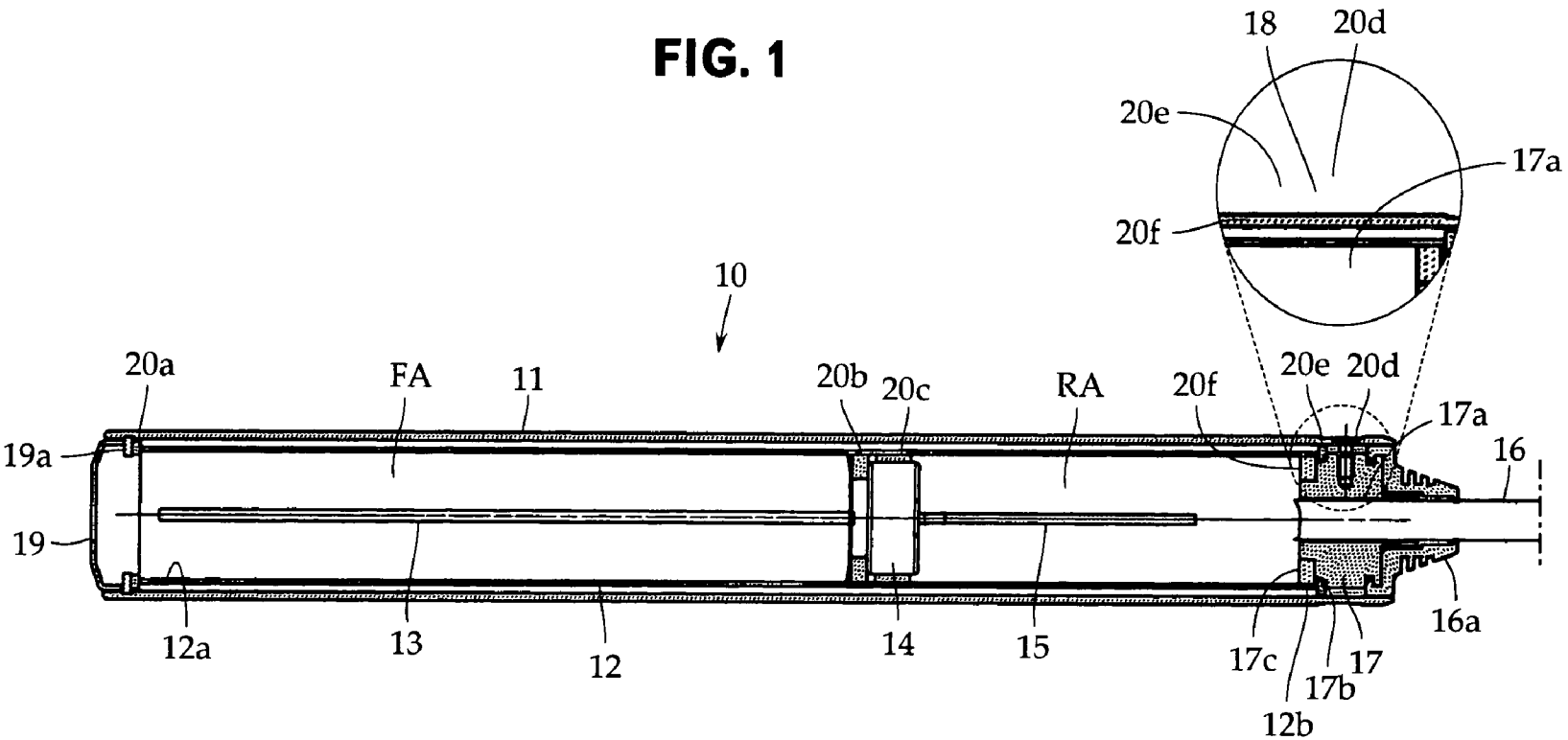
FIG. 1 is a sectional view showing a line microphone as one example of a condenser microphone in accordance with the present invention.
Figure 2:
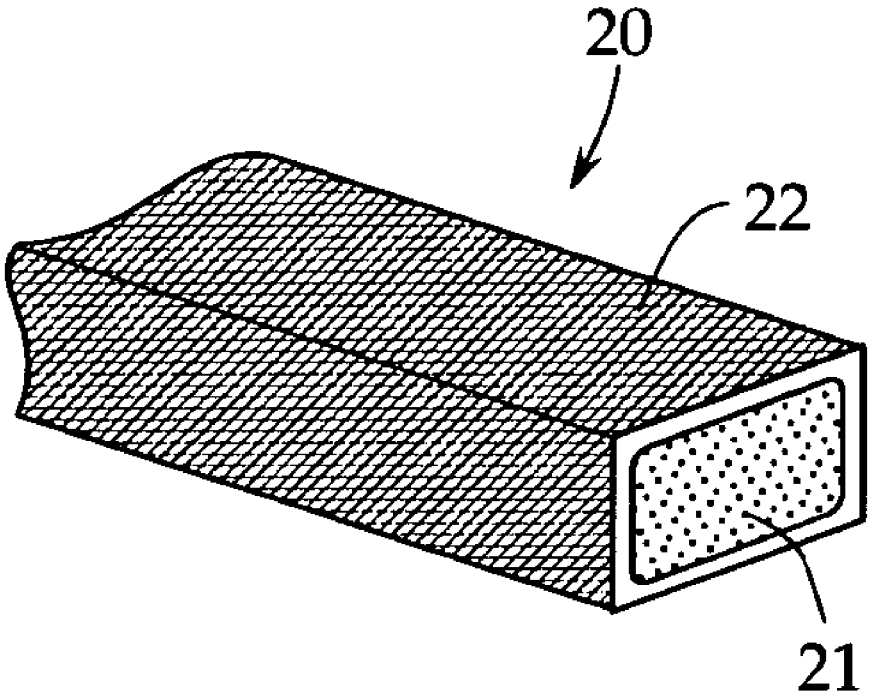
FIG. 2 is a perspective view showing a part of a gasket used as a shock mount member of the line microphone shown in FIG. 1.

An embodiment of the present invention will now be described with reference to FIGS. 1 and 2. The present invention is not limited to this embodiment. FIG. 1 is a sectional view showing one example of a condenser microphone in accordance with the present invention, and FIG. 2 is a perspective view of a gasket used in the present invention.

The present invention is explained by using the line microphone (gun microphone) shown in FIG. 1 by way of example. This line microphone 10 has a microphone case (external cylinder) 11 formed into a slender and cylindrical shape and a cylindrical sound tube (internal cylinder) 12 which has a diameter smaller than that of the microphone case 11 and is arranged coaxially in the microphone case.

Both of the microphone case 11 and the sound tube 12 are made of a metal. In this example, the microphone case is made of aluminum, and the sound tube is made of brass. The sound tube 12 is provided with a slit 13 formed axially to provide narrow directivity.

The sound tube 12 contains a condenser microphone unit (capsule) 14. This condenser microphone unit 14 divides the interior of the sound tube 12 into a front sound air chamber FA on the left-hand side in FIG. 1 and a rear sound air chamber RA on the right-hand side in FIG. 1.

The rear sound air chamber RA contains a circuit board 15 mounted with an audio output circuit etc., not shown, so that the rear sound air chamber RA is also an audio output module section. The circuit board 15 is mounted with a power source circuit for supplying a polarization power source to the condenser microphone unit 14, and therefore the audio output module section is sometimes called a power module section.

The rear end portion of the microphone case 11 is connected with a microphone cable 16. As the microphone cable 16, a two-core shield coated wire is used, and at one end thereof is provided a disc-shaped connecting member 17 fitting in the microphone case 11.

The connecting member 17 is provided with an insertion hole 17*a* in the central portion thereof, and on one surface of the connecting member 17 on the side on which the connecting member 17 is inserted in the microphone case 11, there are formed a first engagement step portion 17*b* for supporting the rear end portion of the sound tube 12 and a second engagement step portion 17*c* for arranging a shock mount member between the connecting member 17 and the inner surface of the sound tube 12. The other surface of the connecting member 17 is covered with a rubber-made cord bush 16*a*.

The microphone cable 16, penetrating the cord bush 16*a* in a state in which a shield coating, not shown, is exposed, is fixed in the insertion hole 17*a*, and the connecting member 17 is fitted in the rear end portion of the microphone case 11 and is fixed by a screw 18. At this time, the rear end portion of the sound tube 12 is supported by the first engagement step portion 17*b*.

In the assembled state shown in FIG. 1, the microphone case 11 and the sound tube 12 are brought into contact with the connecting member 17, and are connected electrically to the shield coating of the microphone cable 16 via the connecting member 17. In this case, the contact portion provides a point contact, and has a high impedance against a high-frequency current caused by electromagnetic waves, so that the shield is incomplete.

To avoid the incomplete shield, in the present invention, a gasket which is formed by coating the surface of a core formed of an elastic material with a conductive material is used in a joint portion of at least a part relating to the shield. FIG. 2 shows one example of this gasket. This gasket 20 has a core material 21 having elasticity, and the whole circumference thereof is covered with a conductive fiber (conductive fabric) 22. As the core material 21, a columnar or cylindrical body formed of an elastic material such as sponge or rubber is used.

As the conductive fiber 22, a conductive fiber formed by nickel-plating a sliver-coated nylon fabric is suitably used. For the gasket 20 of this kind having both elasticity and conductivity, SOFT SHIELD 5000 (trade name) manufactured by Taiyo Wire Cloth Co., Ltd. is available. The conductive fiber 22 may be a fabric into which a coil wire is braided.

The gasket 20 functions as a shock mount member because the core material 21 has elasticity. In this example, therefore, the gasket 20 is used as a shock mount member 20*a* for supporting a front end portion 12*a* of the sound tube 12.

This shock mount member 20*a*, which is formed into a ring shape, is fitted in the distal end portion of the microphone case 11 so as to be in contact with the front end portion 12*a* of the sound tube 12, and is fixed in a pressed state by a stopper ring 19*a* attached to a microphone cover 19. Thereby, electrical connection between the microphone case 11 and the sound tube 12 is secured. Also, in the sound tube 12, a shock mount member 20*b* (conventionally a rubber material), which is formed into a ring shape and is used to fix the condenser microphone unit 14, is provided. The gasket 26 is also used as the shock mount member 20*b*, by which a unit case (usually made of aluminum) of the condenser microphone unit 14 and the sound tube 12 can be connected electrically to each other.

Further, the gasket 20 is applied to a shock mount member 20*c* (conventionally a rubber material) arranged around the condenser microphone unit 14, by which the unit case of the condenser microphone unit 14 and the sound tube 12 can surely be connected electrically to each other.

Also, when the connecting member 17 is fitted in the microphone case 11, it is preferable that a shock mount member 20*d* formed by the gasket 20 be arranged therebetween and be screw-mounted. According to this configuration, even if the screw 18 loosens, the gasket 20 achieves a multi-point electrical contact state, so that no noise is generated.

Also, the gasket 20 is used as shock mount members 20*e* and 20*f* ((conventionally rubber materials) that are arranged in the first engagement step portion 17*b* and the second engagement step portion 17*c* of the connecting member 17, respectively. Thereby, the rear step portion 12*b* side of the sound tube 12 can surely be connected electrically to the connecting member 17 and the microphone case 11.

According to the gasket 20, the core material 21 has elasticity, and the conductive fiber (fiber-like conductive material) 22 covering the surface of the core material 21 is always in contact with the metallic member at many points, so that the contact portion is in a low impedance state.

Therefore, the shield of the microphone case 11 and the sound tube 12 is stable, so that a high-frequency current caused by electromagnetic waves does not flow into the audio output module of the rear sound air chamber RA, which prevents the generation of noise caused by electromagnetic waves. Also, even if stress is applied from the outside, the low impedance state is maintained, so that there is no fear of generating contact noise (vibration noise).

The above is an explanation of the present invention given by taking the line microphone, in which the metallic sound tube is housed in the slender and cylindrical microphone case, as an example. The present invention is not limited to this case, and can widely be applied to a condenser microphone in which a metallic internal cylinder having a condenser microphone unit therein is supported in a metallic external cylinder via a shock mount member.

The present application is based on, and claims priority from, Japanese Application Serial Number JP2004-311800, filed Oct. 27, 2004, the disclosure of which is hereby incorporated by reference herein in its entirety.

The invention claimed is:

1. A condenser microphone which includes an external cylinder and an internal cylinder, both of which are made of a metal, the internal cylinder being arranged in the external cylinder via shock mount members having elasticity, and the internal cylinder containing a substrate including an audio output circuit of a condenser microphone unit, characterized in that a gasket formed by covering the surface of a core formed of an elastic material with a conductive material is used as the shock mount members, by which the external cylinder and the internal cylinder are connected electrically to each other via the gasket.

2. The condenser microphone according to claim 1, characterized in that the condenser microphone unit is supported in the internal cylinder via the gasket.

3. The condenser microphone according to claim 1, characterized in that a microphone cable consisting of a two-core shield coated wire is provided, the microphone cable being provided with a connecting member which is connected electrically to the shield coating, and the connecting member is fitted to one end of the external cylinder via the gasket and is screw-mounted to the external cylinder.

* * * * *